United States Patent [19]

Sanders, Jr. et al.

[11] Patent Number: 4,531,848

[45] Date of Patent: Jul. 30, 1985

[54] DOT MATRIX PRINT HEAD

[75] Inventors: Royden C. Sanders, Jr., Burton Hwy., Wilton, N.H. 03086; John L. Forsyth, Box 182, Newton Junction, N.H. 03851

[73] Assignees: Royden C. Sanders, Jr., Wilton; John L. Forsyth, Newton Junction, both of N.H.

[21] Appl. No.: 436,950

[22] Filed: Oct. 27, 1982

[51] Int. Cl.[3] ..... B41J 3/12

[52] U.S. Cl. ..... 400/124; 101/93.05

[58] Field of Search ..... 400/124; 101/93.05; 335/270, 279

[56] References Cited

U.S. PATENT DOCUMENTS

| | | | |
|---|---|---|---|
| 4,206,266 | 6/1980 | Bellinger | 400/124 X |
| 4,236,836 | 12/1980 | Hodne | 335/274 X |
| 4,389,127 | 6/1983 | Bellinger | 400/124 |
| 4,403,875 | 9/1983 | Asano et al. | 400/124 |

FOREIGN PATENT DOCUMENTS

| | | | |
|---|---|---|---|
| 2543170 | 4/1976 | Fed. Rep. of Germany | 400/124 |

*Primary Examiner*—Paul T. Sewell

*Attorney, Agent, or Firm*—Hayes, Davis & Soloway

[57] ABSTRACT

A dot matrix print head includes a solenoid and a spring assembly for driving a print pin, with a positioning means for holding the assemblies in a predetermined relation. The solenoid assembly preferably has a first positioning means adjacent its upper surface and a second positioning means preferably forms a part of the spring assembly. The first and second positioning means are preferably circumferential and the second means is preferably adapted to engage the first positioning means around more than 180° of arc thereof and is expandable to permit sliding engagement with the first positioning means so as to hold the spring assembly locked onto the solenoid assembly. Preferably a molded stiffening rib is carried by the spring assembly and extends from the armature to the pin-carrying tip of the spring assembly. The molded pin support is formed integrally with the stiffening rib and permits rotation of the end of the pin in the support. It is also preferred that there be a molded pad carried by the stiffening rib to engage an impact absorbing member during return of the printing pin from printing position.

12 Claims, 10 Drawing Figures

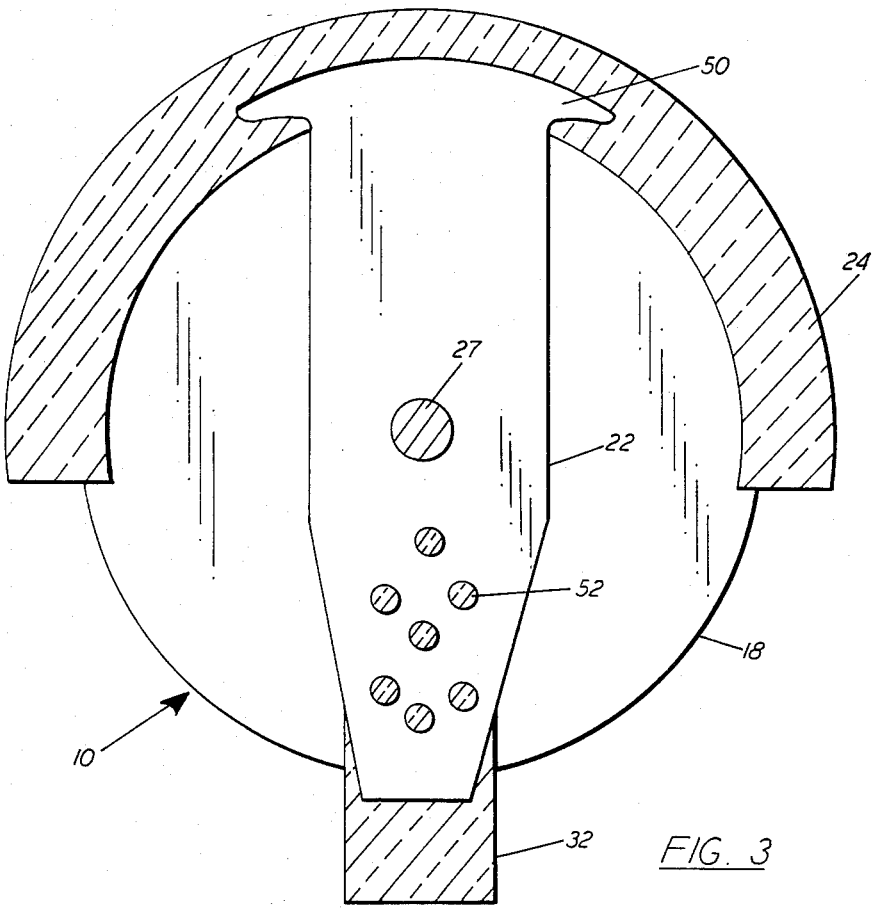
FIG. 3
FIG. 4
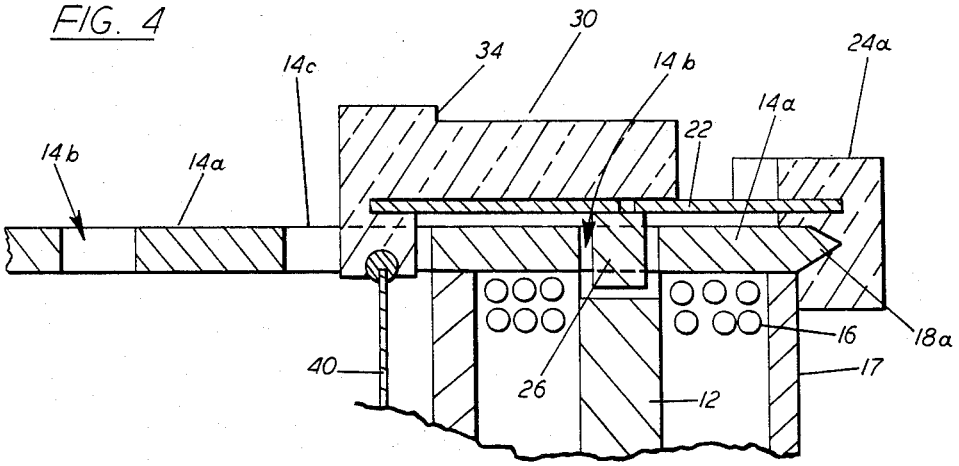

DOT MATRIX PRINT HEAD

The present invention relates to dot matrix printers and more particularly to improvements in dot matrix print heads. Various types of dot matrix printers are described in the following U.S. Pat. Nos. 3,151,543, Preisinger, 4,059,183, Hoskins, 4,159,882, Sanders, Jr. et al, 4,279,518, Blomquist et al, 4,284,363, Choberra et al, 4,291,992, Barr et al, 4,309,116, Maeda, 4,317,635, Englund et al, 4,320,981, Harrison et al.

In such dot matrix printers, it is important that the dot matrix print pin be properly damped before refiring in order to get uniform dot density. It is also important that the firing mechanism have a minimum amount of mass consistent with adequate mechanical strength since speed of operation is critically dependent upon the mass of the moving elements in the combination. The dot matrix print head which is the subject matter of this invention involves a combination of several unique design features which improve the firing speed while providing minimum manufacturing costs without sacrifice of reliability.

For convenience of description, the invention will be initially described in connection with a single solenoid and a single dot matrix print pin. As will be apparent to one skilled in the art, any number of such dot matrix pins, with associated solenoids, may be arranged in any desired configuration to give a high speed dot matrix printer. A preferred use of the present matrix print head is in a four pin print head of the type described more fully in the copending application filed by Royden C. Sanders, Jr. on even date herewith.

According to the invention there is provided a dot matrix print head which includes a solenoid and a spring assembly for driving a print pin, with a positioning means for holding the assemblies in a predetermined relation. The solenoid assembly preferably has a first positioning means adjacent its upper surface and a second positioning means forming a part of the spring assembly. The first and second positioning means are preferably circumferential with the second means adapted to engage the first positioning means around more than 180° of arc thereof and is expandable to permit sliding engagement with the first positioning means so as to hold the spring assembly locked onto the solenoid assembly. Preferably a molded stiffening rib is carried by the spring assembly and extends from the armature to the pin-carrying tip of the spring assembly. The molded pin support is formed integrally with the stiffening rib and permits rotation of the end of the pin in the support. It is also preferred that there be a molded pad carried by the stiffening rib to engage an impact absorbing member during return of the printing pin from printing position.

Reference should be had, by way of example, to the following detailed drawings, wherein:

FIG. 3 is a plan view taken along line 3—3 which is the upper surface of the leaf spring;

Figure 4A:
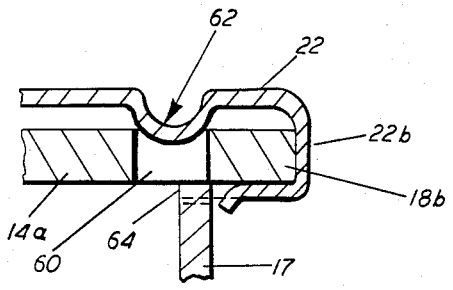
FIG. 4 is a diagrammatic schematic sectional view through a portion of one solenoid showing a modification of the invention of FIG. 1.
Figure 5A:
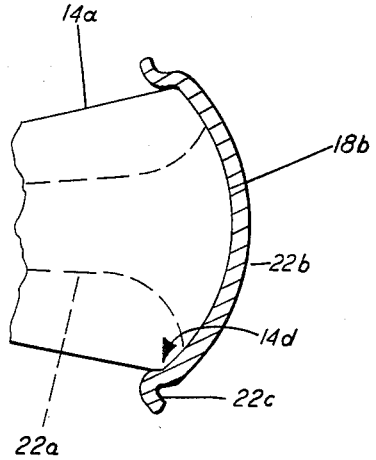
Figure 6:
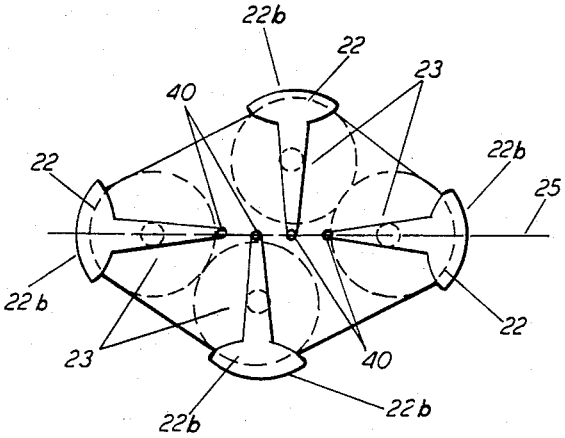
Figure 5:
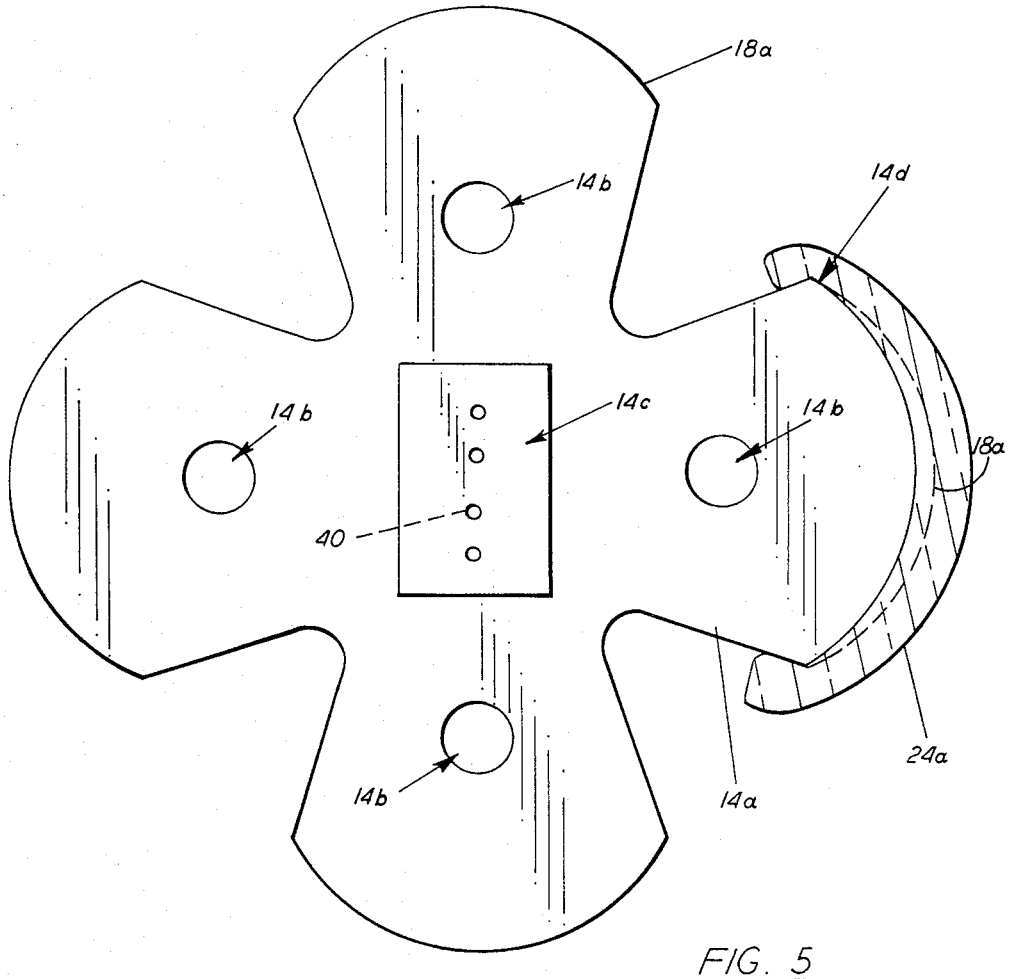

FIG. 4*a* is a section similar to a portion of FIG. 4 showing another embodiment of the invention;

FIG. 5 is a plan view of the multi-armed metallic plate;

FIG. 5*a* is a portion of FIG. 5 showing another form of the invention; and FIG. 6 is a schematic plan view of a four pin matrix print head utilizing the invention.

Figure 1:
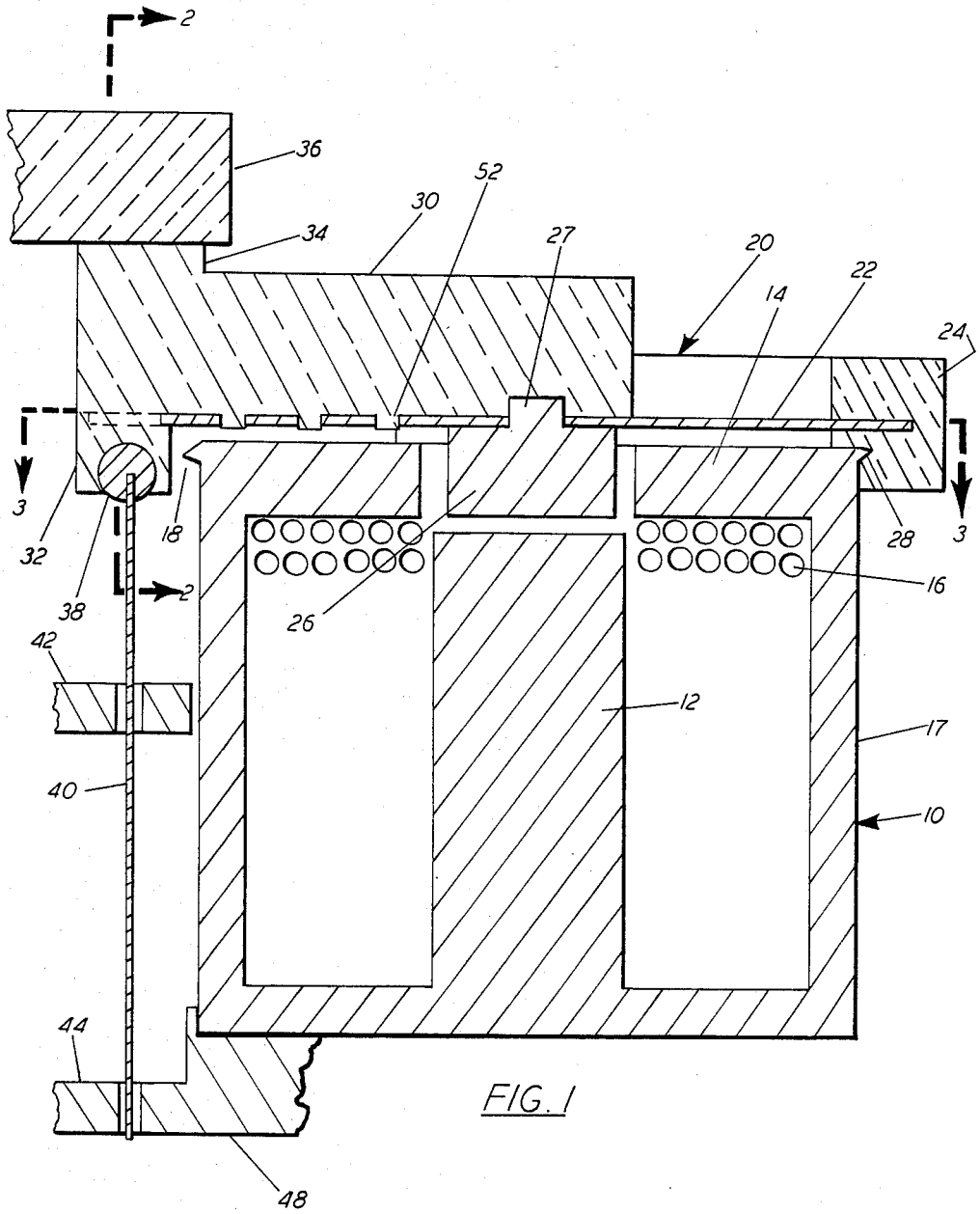
FIG. 1 is a diagrammatic schematic sectional view through one solenoid with its associated print pin and spring assembly.
Figure 2:
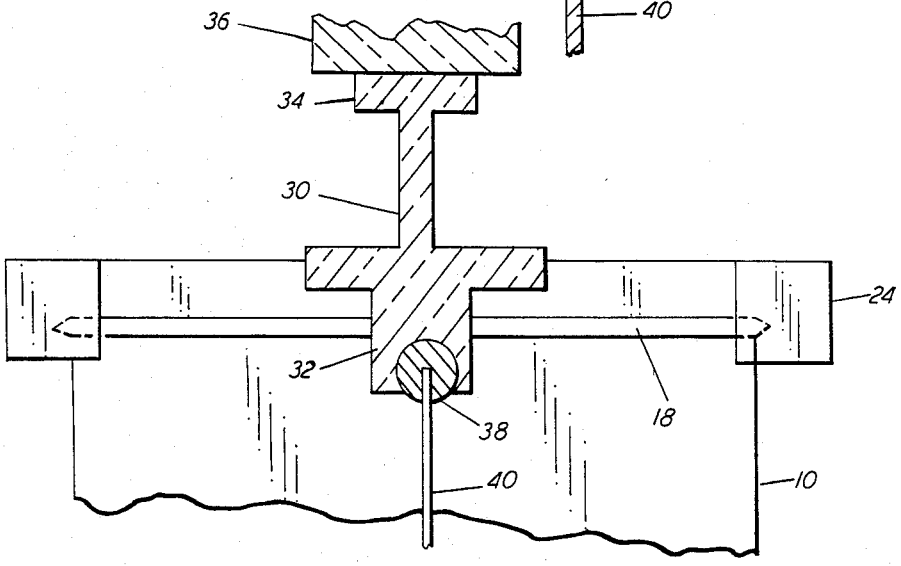
FIG. 2 is a partial sectional view taken along line 2—2 of FIG. 1.

Referring now specifically to FIG. 1, there is shown a solenoid assembly generally indicated at 10, comprising pole piece 12 with return path 14 and energizing coil 16 (a portion only of which is shown). The exterior of the housing 17 is cylindrical and forms part of the return path and has an outwardly extending annular lip 18, of generally triangular cross-section, shown at the upper edge of the solenoid assembly. The spring assembly, generally indicated at 20, comprises a leaf spring 22 and an integrally molded plastic positioning means 24 which, as can be seen in FIGS. 2 and 3, includes two arms which subtend more than 180° of arc around the housing 10 of the solenoid assembly. Groove 28 (of cross-section to match that of lip 18) in the positioning means 24 intimately engages the outwardly extending lip 18 on the solenoid assembly 10 and holds the spring assembly fixedly secured thereto. As can be seen, particularly from examination of FIG. 3, the positioning means 24 comprises two arms which extend around the periphery of solenoid 10 and extends around somewhat more than 180° of circumference. When the two arms are forced into position, the arms being slightly flexible, they tightly grip the solenoid assembly 10 and lock the spring assembly in a predetermined fixed relationship to the solenoid assembly.

The spring assembly 20 also carries armature 26, which is secured to leaf spring 22 by a suitable fastening means 27. A stiffening rib 30 is molded integrally with the leaf spring 22, this being formed of a suitable high impact plastic and being provided with a downwardly extending outer portion 32. This portion 32 has a cylindrical recess for holding a ball 38 forming the top of a print pin 40. The stiffening rib 30 extends along spring 22 from the outer portion 32 to at least the location of the armature 27 and is disposed, in plan symmetrically about a line centered on the pin 40 and the armature 27. The spring may terminate at or short of portion 32 or may extend into portion 32 as shown in ghost in FIG. 1. A portion of the spring between arms 24 and rib 30 is not reinforced in order to provide a desired spring action. Adjacent to the upper outer surface of stiffening rib 30 is an integral pad 34 adapted to engage a shock absorbing member 36 associated with the print head housing (not shown). Member 36 is preferably formed of plastic having energy absorbing characteristics. Guides 42 and 44 serve to guide the print pin during the printing stroke. A support 48, partially shown, positions the solenoid 10 and its spring assembly 20 with respect to the guides 42 and 44.

In manufacturing the leaf spring assembly, the spring and its associated armature 26, are placed in a jig. The positioning arms 24 and the elements associated with the stiffening rib 30 are then molded around the leaf spring 22. To intimately bond the rib 30 to the leaf spring 22, holes 52 are provided, which permit the plastic of rib 30 to securely bond to the leaf spring 22. A preferred embodiment of the leaf spring also provides extensions 50, which extend into the molded arms 24 of the positioning means. During the molding operation the enlarged head of the print pin 38 is also positioned in the jig so that the depending portion 32 of the stiffening member partially surrounds the ball 38 and holds it in a fixed relationship to the spring. The ball 38 and socket in the portion 32 are arranged so that there is no bonding of the materials whereby the pin can pivot about the center of the ball within the limits dictated by the opening of the socket. To permit this slight rotation of the ball in the depending portion 32, in a preferred embodiment, the surface of the ball of the enlarged head 38 is treated (e.g. with a release agent) so that it does not bond tightly to the plastic forming the depending portion 32.

In assembling the devices described above, the spring assembly is forced onto the upper end of the solenoid assembly being held fixedly by means of arms 24 which are slightly spread apart in order to pass over the maximum diameter of the positioning lip 18 carried by the upper surface of the solenoid assembly.

In operation of the device, the solenoid coil 16 is operated and it attracts armature 26 which moves the spring and stiffening member 30 downwardly to impart a printing force to the print pin 40. When the brief printing pulse is terminated, the spring 22 forces the print pin 40 upwardly and the shock absorbing surface 34 on the top of the stiffening member 30 impacts shock absorbing member 36. Member 36 defines the upper limit of the return path of the stiffening member 30 and surface 34 after a print stroke. Member 36 serves to dampen the blow and the spring assembly is held in the position shown in FIG. 1 by means of the spring 22, the whole assembly being ready for the next printing stroke.

While a preferred embodiment of positioning means has been described above numerous modifications can be made therein. For example the lip 18 could be carried by arms 24 and a working groove could be provided in the upper surface of solenoid assembly 10.

Figure 1A:
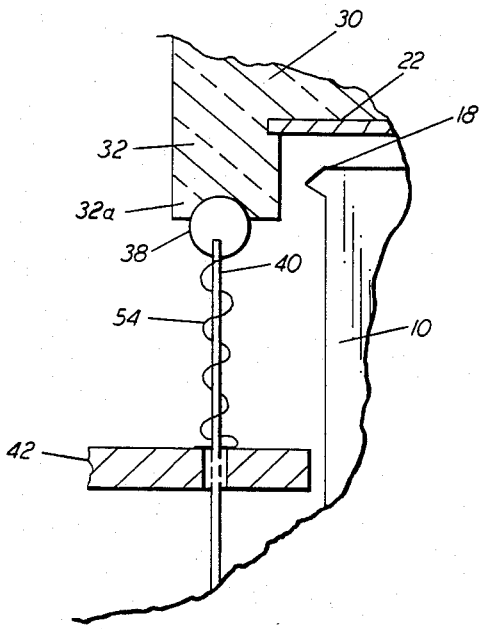
FIG. 1A is a portion of FIG. 1 (partially sectional) showing a modification of the invention of FIG. 1.

The preferred method of supporting the print pin 40 includes the depending portion 32 of the stiffening member which surrounds the head 38 of the pin. If it is desired to operate the print pin in the ballistic mode the bottom part of portion 32 is removed so that portion 32 no longer surrounds head 38 but merely contacts and laterally locates the rounded head 38. This modification is shown in FIG. 1A wherein surface 32A contacts the upper surface of rounded head 38 for imparting a driving (printing) force to pin 40. In this case a separate spring 54 is provided for returning the pin 40 to refire position after the printing stroke. If spring 54 is relatively weak it will permit the pin 40 to operate in the "ballistic mode" e.g. the head 38 will leave contact with surface **32*a*. If spring 54 is relatively strong the pin will operate in the "compression mode" e.g. the pin head 38 will remain in contact with surface 32*a*** during the whole print stroke.

Figure 1B:
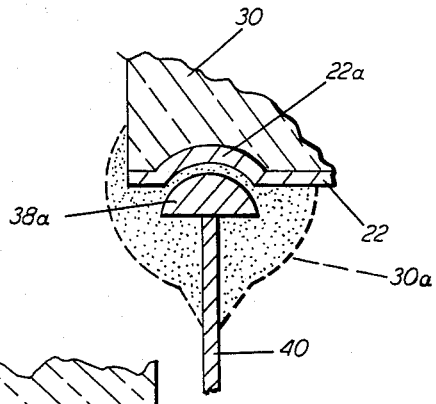
FIG. 1B is similar to FIG. 1A and shows still another modification of the invention.

In still another embodiment of the invention shown in FIG. 1B the leaf spring member 22 extends over the end of the print pin and has a coined recess **22*a* having a spherical concave surface which matches the end radius 38*a* of the print pin 40. This radius 38*a* may be a cold headed end of print pin 40 or can be a separate metal or plastic hemisphere or part sphere secured to the end of the print pin 40. In either case the print pin end 38*a* can be carried by the spring by being encapsulated as shown in ghost at 30*a* by the plastic of the stiffening rib 30 or by a separate more flexible, plastic such as silicone rubber (RTV) as sold by Dow Corning, Inc. If the print pin of FIG. 1B is to be used in the ballistic mode it will have the spring 54 of FIG. 1A**.

In a preferred embodiment of the invention the print wire is a steel wire having a diameter of 0.014 inch. A suitable plastic for molding the arms 24 and stiffening rib 30 is a high temperature resistant Nylon 66+ carbon fiber compound such as sold by Fiberfil Inc., Evansville, Ind. et al. The spherical recess in the leaf spring of FIG. 1B can have a radius of 0.100 inch with a depth of 0.006 inch if it is to match a fairly large end 38 on print wire 40 where the end 38 of print wire 40 is cold headed to a spherical radius of 0.014 inch then the recess **22*a*** also preferably has a 0.014 inch radius.

Referring now to FIGS. 4 and 5 there is shown still another embodiment of the invention wherein a common plate **14*a* serves as the magnet return path for all of a plurality of solenoids. In this embodiment, which is a slight modification of design of FIG. 1, a single multi-armed plate 14*a* serves as a return path for each of four solenoids. It will be appreciated that more solenoids may be provided. FIG. 4 is a partial sectional view similar to FIG. 1 showing one of the solenoids but with the plate extending beyond the single solenoid. In FIG. 5 there is a plan view of the multi-armed plate 14*a* showing one pair of arms 24*a* which are adapted to engage the triangular cross-section end 18*a* of the plate 14*a* and to extend around the corners 14*d* whereby the arms are held resiliently captive by the corners 14*d*. A hole 14*b* in each arm of the plate 14*a* permits passage of the armature 26 carried by the leaf spring 22. A central opening 14*c* provides spaces for the inner ends of the spring assemblies and their associated print pins 40 (shown in the hole 14*c*). In fact the pins 40 would not normally appear in the plane of the plate 14*a***.

While one embodiment of an alternative arrangement of a multi-armed plate **14*a* is shown in FIGS. 4 and 5 numerous modifications can be employed without departing from the spirit of the invention. Additionally the leaf spring itself may be provided with a detent which engages a corresponding hole in plate 14*a* to lock the spring assembly into position when it has been slid into the proper location on the plate 14*a*. In this embodiment (shown in FIGS. 4A) the end of the leaf spring can extend over the end of the plate 14*a*. The leaf spring 22 is provided with a pair of dimpled downwardly extending detents 62 (one only being shown) which match a pair of holes 60 in the metallic plate 14*a* of FIG. 4. Obviously this detent could be in a plate such as plate 14 of FIG. 1. In both FIGS. 4*a* and 5*a* the cast arms 24 are omitted and the end of the leaf spring is turned downwardly at 22*b* to extend around end 18*b* of plate 14*a*. In FIG. 5*a* the leaf spring is provided with inwardly extending arms 22*c* to grip the end of each arm 14*a* by extending around the corners 14*d* thus clamping the leaf spring assembly securely to the arm 14*a*. The extent of the inward portion of the leaf spring 22 is shown in dotted lines at 22*a* in FIG. 5*a***.

In yet another variation the detent/hole arrangement illustrated in FIG. **4*a* may be combined with a slot 64 in the upper edge of housing 17 (shown in ghost) and the portion of the leaf spring which extends downwardly around end 18*b* extends (as shown in ghost in FIG. 4*a*) into this slot 64 to assist in correctly orienting the leaf spring 22** and the armature and print wire it carries.

In FIG. 6 there is illustrated a preferred geometric arrangement of a four pin dot matrix head having four leaf springs 22 driven by four armatures 26 for activating four print pins 40. In this case a multi-armed plate 14 of the type shown in FIGS. 4 and 5 supports the springs 22 at the ends 22*b* thereof by means such as shown in FIG. 4*a*.

In FIG. 6 solenoids 23 and their associated pin-assemblies are disposed as one opposed pair on the straight line 25 with a second pair disposed transversely of line 25 in opposed offset relationship to provide a linear row of equi-spaced pins 40.

We claim:

1. A dot matrix print head comprising a solenoid assembly having a magnetic return path constituting a metallic plate adjacent to its upper surface, a first positioning means forming a part of said plate, a printing pin carried by a spring assembly, a second positioning means forming a part of the spring assembly, said second positioning means being adapted to resiliently engage said first positioning means and being expandable to permit sliding engagement with the first positioning means and to hold the spring assembly locked onto the solenoid assembly, the metallic plate having detent means engageable by corresponding expandable detent means carried by the spring assembly and constituting the second positioning means, said first positioning means being circumferential and the second positioning means engaging the first positioning means around more than 180° of an arc, a pair of arms carried by the spring assembly constituting the second positioning means, said arms being adapted to engage said first positioning means around more than 180° of arc thereof and being expandable to permit sliding engagement with the first positioning means and to hold the spring assembly locked onto the solenoid assembly.

2. The dot matrix print head of claim 1 wherein the leaf spring constituting a part of the spring assembly includes laterally extending portions which are molded into the arms of the second positioning means.

3. A dot matrix print head comprising a solenoid assembly, a spring assembly secured to the solenoid assembly, the spring assembly carrying an armature, a printing pin carried by the spring assembly, a molded stiffening rib carried by the spring assembly extending from the armature to the pin carrying tip of the spring assembly, a molded pin support being formed integrally with the stiffening rib, an enlarged head on the pin for engaging the pin support, the pin support forming a socket which permits rotation of the end of the pin in the support.

4. The dot matrix print head of claim 3 wherein the solenoid assembly has a first, circumferential, positioning means adjacent its upper surfaces, a second positioning means forms a part of the spring assembly, and said second positioning means is adapted to engage said first positioning means around more than 180° of arc thereof and being expandable to permit sliding engagement with the first positioning means and to hold the spring assembly locked onto the solenoid assembly.

5. The dot matrix print head of claim 3 wherein a spring means forming part of the spring assembly extends over the end of the print pin.

6. A dot matrix print head comprising a solenoid assembly, a spring assembly secured to the solenoid assembly, the spring assembly comprising a metallic leaf spring carrying an armature, a printing pin arranged to be driven by the spring assembly, a molded stiffening rib carried by the spring assembly extending from the armature to the pin driving tip of the spring assembly, a molded pin driving tip being formed integrally with the stiffening rib, the plane of the leaf spring extending trawnsverse to the axis of the solenoid, the stiffing rib being generally parallel to the solenoid axis, the metallic leaf spring extending over the end of the print pin, the end of the leaf spring being coined to provide a recess whose radius matches and engages an upper spherical surface on the print pin.

7. The dot matrix print head of claim 6 wherein the spherical surface is a plastic element secured to the end of the print pin.

8. A dot matrix print head comprising a solenoid assembly having a magnetic return path constituting a metallic plate adjacent to its upper surface, a first positioning means forming a part of said plate, a printing pin carried by a spring assembly, a second positioning means forming a part of the spring assembly, said second positioning means being adapted to resiliently engage said first positioning means and being expandable to permit sliding engagement with the first positioning means and to hold the spring assembly locked onto the solenoid assembly, the metallic plate having detent means engageable by corresponding expandable detent means carried by the spring assembly and constituting the second positioning means, said first positioning means being circumferential and the second positioning means engaging the first positioning means around more than 180° of an arc, the first positioning means including a triangular circumferential rib which engages a matching triangular groove in the second positioning means.

9. A dot matrix print head comprising a solenoid assembly, a spring assembly secured to the solenoid assembly, the spring assembly comprising a metallic leaf spring carrying an armature, a printing pin arranged to be driven by the spring assembly, a molded stiffening rib carried by the spring assembly extending from the armature to the pin driving tip of the spring assembly, a molded pin driving tip being formed integrally with the stiffening rib, the plane of the leaf spring extending transverse to the axis of the solenoid, the stiffening rib being generally parallel to the solenoid axis, the molded stiffening rib extending through holes in a leaf spring constituting a part of the spring assembly.

10. A dot matrix print head comprising a solenoid assembly including a plurality of solenoids each having a first positioning means adjacent its upper surface, a plurality of a printing pins arranged to be driven by individual spring assemblies, a second positioning means forming a part of each spring assembly, said second positioning means being resiliently expandable to permit sliding engagement with its associated first positioning means and to hold the spring assembly locked in a desired position onto the solenoid assembly, a plurality of the individual solenoids have a common magnetic return path adjacent the upper surfaces thereof, the first positioning means being part of the common magnetic return path, the common magnetic return path constituting a metallic plate having detent means engageable by corresponding expandable detent means carried by the spring assembly and constituting the second positioning means, the expandable detent means being formed from the material of a leaf spring included in the spring assembly.

11. The dot matrix print head of claim 10 wherein the detent means is expandable laterally to engage a lateral portion of the metallic plate.

12. The dot matrix print head of claim 10 wherein the detent means is expandably vertically to engage a vertical detent in the metallic plate.

* * * * *

UNITED STATES PATENT AND TRADEMARK OFFICE

CERTIFICATE OF CORRECTION

PATENT NO. : 4,531,848

DATED : July 30, 1985

INVENTOR(S) : Royden C. SANDERS, Jr. & John L. FORSYTH

It is certified that error appears in the above-identified patent and that said Letters Patent are hereby corrected as shown below:

Claim 6, column 2, line 1 the term "trawnsverse" should be "transverse".

Signed and Sealed this

*Fifteenth* Day of *October 1985*

[SEAL]

*Attest:*

*Attesting Officer*

DONALD J. QUIGG

*Commissioner of Patents and Trademarks—Designate*